US008104694B2

(12) United States Patent
Yang

(10) Patent No.: US 8,104,694 B2
(45) Date of Patent: Jan. 31, 2012

(54) AIR SPRAY GUN

(76) Inventor: Chih-Yuan Yang, Sinjhuang (TW)

( * ) Notice: Subject to any disclaimer, the term of this patent is extended or adjusted under 35 U.S.C. 154(b) by 0 days.

(21) Appl. No.: 12/068,350

(22) Filed: Feb. 5, 2008

(65) Prior Publication Data

US 2011/0210190 A1 Sep. 1, 2011

(51) Int. Cl.
*B05B 1/28* (2006.01)

(52) U.S. Cl. ..... 239/291; 239/296

(58) Field of Classification Search ..... 239/290–301, 239/391, 392, 394, 437–442
See application file for complete search history.

(56) References Cited

U.S. PATENT DOCUMENTS 4,728,039 A * 3/1988 Johnson et al. ..... 239/296
4,961,536 A * 10/1990 Correard ..... 239/296
5,322,221 A * 6/1994 Anderson ..... 239/291
6,527,200 B1 * 3/2003 Huang ..... 239/296
7,143,963 B2 * 12/2006 Tani et al. ..... 239/456
7,237,727 B2 * 7/2007 Wang ..... 239/291

* cited by examiner

*Primary Examiner* — Davis Hwu
(74) *Attorney, Agent, or Firm* — Muncy, Geissler, Olds & Lowe, PLLC

(57) ABSTRACT

An air spray gun is used to blow dry a painted surface of cold baked coating, wherein an air-taking ring in a shape of an annular air chamber is formed after screwing a front tube with a rear tube in the air spray gun, and a gap size of the air-taking ring can be changed by rotating the front tube, to control air blow rate as required. Through a position-limiting slot formed at the front tube, and a position-limiting element assembled at the rear tube, when the gap size of the air-taking ring is adjusted, the rotation of the front tube is properly restricted. In addition, by screwing the front tube with the rear tube, functions of disassembling and cleaning can be achieved.

8 Claims, 6 Drawing Sheets

AIR SPRAY GUN

BACKGROUND OF THE INVENTION a) Field of the Invention

The present invention relates to an air spray gun which is used to blow dry a painted surface of cold baked coating, and more particularly to an air spray gun, wherein a gap size of an air-taking ring can be adjusted according to an air blow rate.

b) Description of the Prior Art

Referring to FIG. 1, it shows a cutaway view of a conventional air spray gun, wherein the air spray gun 10 is composed of an air spray tube 101 and a grip 102, and the air spray tube 101 is assembled by a front tube 1011 and a rear tube 1012 into a unit which is not able to be disassembled. An interior of the front tube 1011 is formed with an air-discharge conduit 10111, a rear end on an outer wall of the front tube 1011 is formed with a groove 10112, and the front tube 1011 is formed with a screw-hole 10113 which is connected with the groove 10112. An interior at a rear end of the rear tube 1012 is formed with a slant air-suction conduit 10121 which is gradually converged inward, and a front end of the rear tube 1012 is provided with a flange 10122 which can be tightly assembled with the groove 10112 of the front tube 1011. Accordingly, after the aforementioned front tube 1011 has been assembled with the rear tube 1012, they cannot be disassembled, and an air-taking ring 1013 of a fixed gap is formed between a rear-end surface of the air-discharge conduit 10111 of the front tube 1011 and a front-end surface of the air-suction conduit 10121 of the rear tube 1012.

Upon using the aforementioned conventional structures, a screw-hole at a bottom of the air spray tube 101 is connected with a high-pressure air tube 103 which is then connected to an exterior air compressor (or air supply system). When external high-pressure air is fed into an annular air chamber which is formed by the groove 10112 of the air spray tube 101, the air will be spraying toward a front along the air-discharge conduit 10111 through the air-taking ring 1013, and air at an exterior of a rear-end opening of the air-suction conduit 10121 of the air spray tube 101 will be driven by a pressure difference to be sucked inward, such that a large quantity of air will be blown forward to blow dry a painted surface of cold baked coating, or to feed the air or blow dry for other purposes. In addition, in using the air spray gun, the rear end of the air spray tube 101 can be sheathed with a rear cap 104 having a filtering net 1041 to filter out impurities or dusts in the air, so as to prevent the impurities or dusts from being dipped on the painted surface.

However, the aforementioned prior art is provided with following shortcomings:

1. As the air-taking ring in the conventional air spray gun is a structure of a fixed gap, a magnitude of air discharge rate cannot be controlled by changing the gap size, resulting in that the air spray gun cannot be applied to all kinds of raw materials of different viscosities for the cold baked coating, thereby causing an inconvenience in usage.
2. As the air-taking ring is the structure of the fixed gap, when the air spray gun is connected with the external high-pressure air device or system, a lower end of the high-pressure air tube should be connected with a control valve which is then connected to the external high-pressure air device, and a valve or an axle part of the control valve will be pasted with a lubricant to maintain a good mobility. However, in using the air spray gun, the aforementioned lubricant is easy to be driven into the air spray tube by the high-pressure air which passes through the control valve, to blow toward the painted surface of water-style cold baked coating, which results in changes of chemical or physical properties of the painted surface, thereby affecting a quality of the painted surface, or even damaging an entire working surface.
3. Even that the air spray gun is sheathed with the rear cap having the filtering net, the dusts will be still accumulated inside the tubes under a long term of usage. As the front tube and the rear tube cannot be disassembled, it will not be easy to clean the dusts in the tubes. Accordingly, it is necessary to make improvement to the aforementioned prior art.

SUMMARY OF THE INVENTION

The primary object of present invention is to provide an air spray gun, wherein a gap size of an air-taking ring can be changed according to an air blow rate or the air-taking ring can be even closed to save an air valve, and a rotation range of a front tube can be restricted. In addition, the air spray gun can be easily disassembled to facilitate cleaning.

Accordingly, an air spray gun of the present invention includes an air spray tube and a grip, wherein the air spray tube is constituted by a front tube, a rear tube, and a fixing ring; the front tube is screwed with the rear tube to form a unit; and an air-taking ring in a shape of an annular air chamber is formed between the front tube and the rear tube after being screwed. A gap size of the air-taking ring can be adjusted by rotating the front tube, and the front tube be tightly locked toward the rear tube by the fixing ring which is screwed at the front tube, to fix the gap of the air-taking ring. However, after assembling a position-limiting slot formed on the front tube and a position-limiting element formed on the rear tube, when the front tube is rotating for adjusting the gap size of the air-taking ring, the rotation range will be restricted without resulting in an excessively large gap size of the air-taking ring by the rotation range which is too large, such that ambient air cannot be sucked in efficiently.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
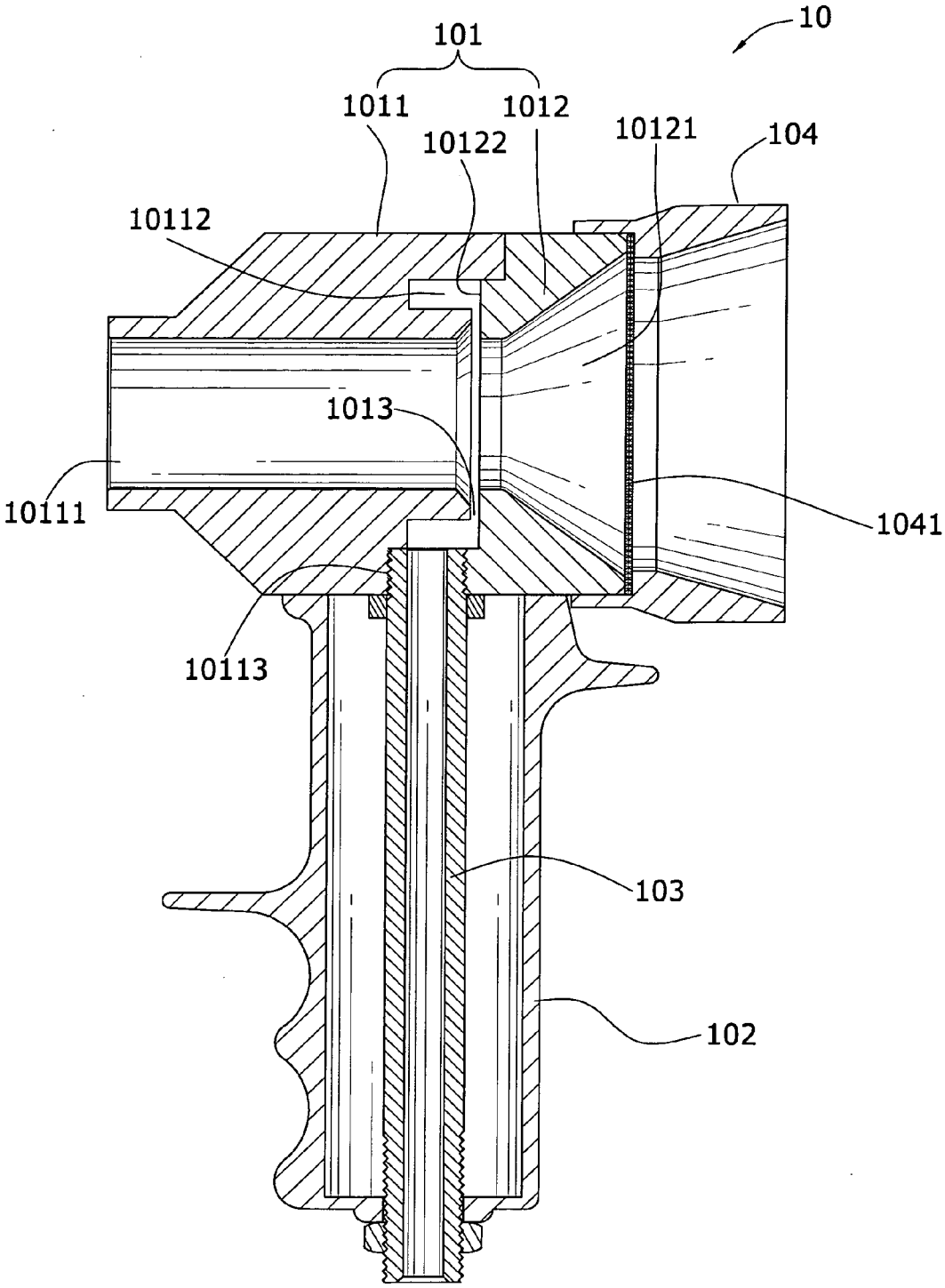
Fig.1 Prior Art
FIG. 1 shows a cutaway view of a conventional air spray gun.
Figure 2:
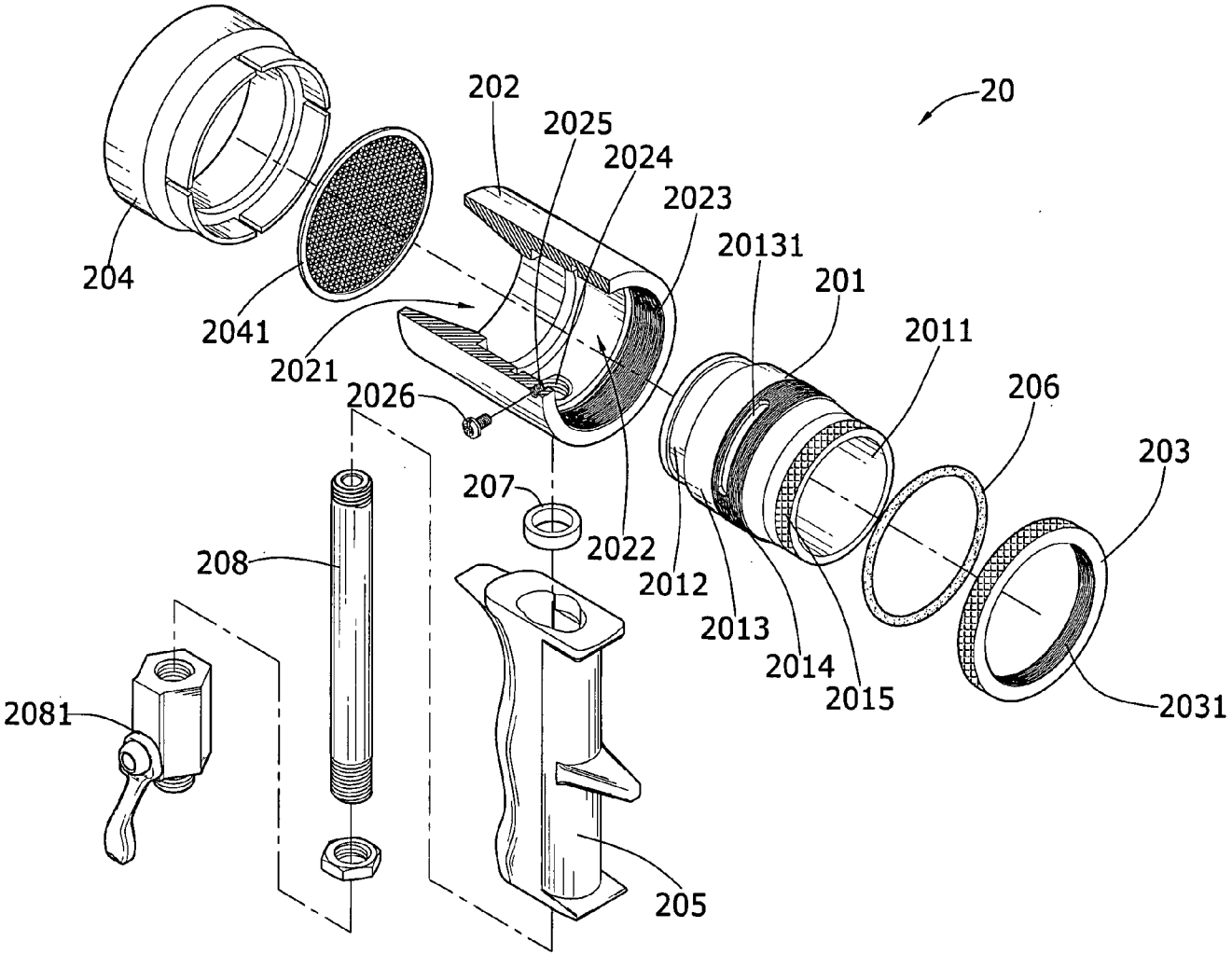
FIG. 2 shows an exploded view of the present invention.

Referring to FIG. 2, it shows an exploded view of the present invention. An air spray gun 20 of the present invention comprises a front tube 201, a rear tube 202, a fixing ring 203, a rear cap 204, and a grip 205, wherein a center of the front tube 201 is formed with an air-discharge conduit 2011, an outer wall of a smaller diameter at a rear section of the front tube 201 is formed with a groove 2012, and along an outer wall of a larger diameter in front of the groove 2012 is formed orderly with a sealing surface 2013, an outer thread 2014, and a force exertion part 2015, with a side of the outer thread 2014 being formed with a position-limiting slot 20131; an end of the rear tube 202 is formed with a slant air-suction conduit 2021 which is gradually converged inward, and a front end of the air-suction conduit 2021 is formed with a round hole 2022, a diameter of which is corresponding to the sealing surface 2013 of the front tube 201, with a wall at an inner rim of an opening end of the round hole 2022 being formed with a first inner thread 2023, a bottom of the round hole 2022 being formed with a first screw-hole 2024, and an exterior side of the rear tube 202 being formed with a second screw-hole 2025 which is screwed and assembled with a position-limiting element 2026; an inner rim of the fixing ring 203 is formed with a second inner thread 2031; the rear cap 204 is a hollow ring, an interior of the rear cap 204 is assembled with a filtering net 2041, and the rear cap 204 can be sheathed at a rear end of the rear tube 202; the grip 205 is fixed at a bottom of the rear tube 202, and an interior of the grip 205 is transfixed with a high-pressure air tube 208, a side of which is assembled with a valve switch 2081; a first rubber ring 206 is assembled inside the rear tube 202, and a second rubber ring 207 is assembled at a joined place between the high-pressure air tube 208 and the rear tube 202.

Figure 3:
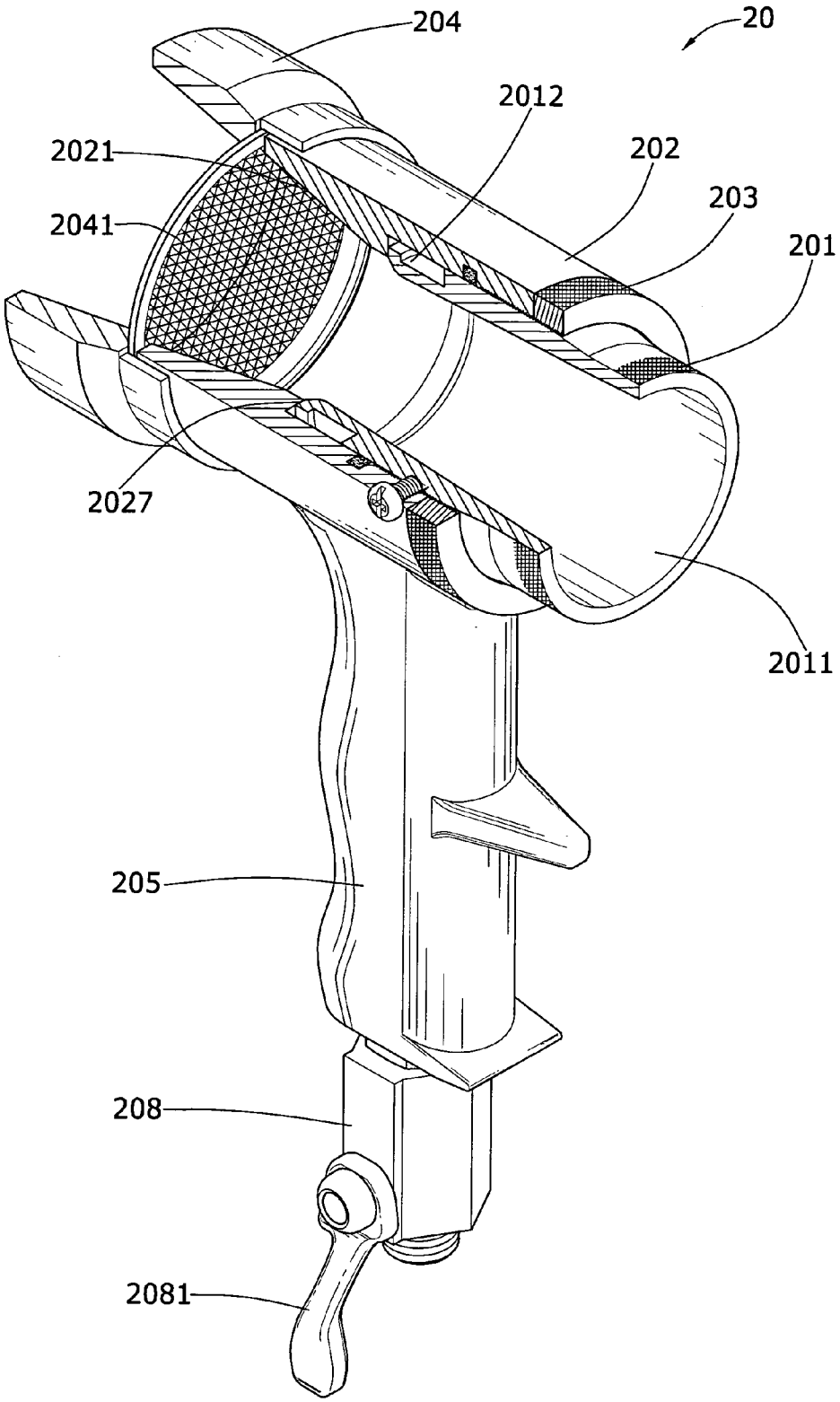
FIG. 3 shows a perspective cutaway view of the present invention.

Referring to FIG. 3, it shows a perspective cutaway view of the present invention. After the front tube 201 has been assembled with the rear tube 202, an annular air chamber is formed between the groove 2012 of the front tube 201 and a wall of the round hole 2022 (not shown in the drawing) of the rear tube 202, and an air-taking ring 2027 is formed between a rear-end surface of the air-discharge conduit 2011 of the front tube 201 and a front-end surface of the air-suction conduit 2021 of the rear tube 202. Next, the fixing ring 203 is screwed on the front tube 201 and tightly locked toward the rear tube 202 to fix a gap of the air-taking ring 2027. After the rear cap 204 has been assembled with the filtering net 2041, they are sheathed at a rear end of the rear tube 202, and the grip 205 is assembled at a bottom of the rear tube 202, with an interior being transfixed with the high-pressure air tube 208.

Figure 4:
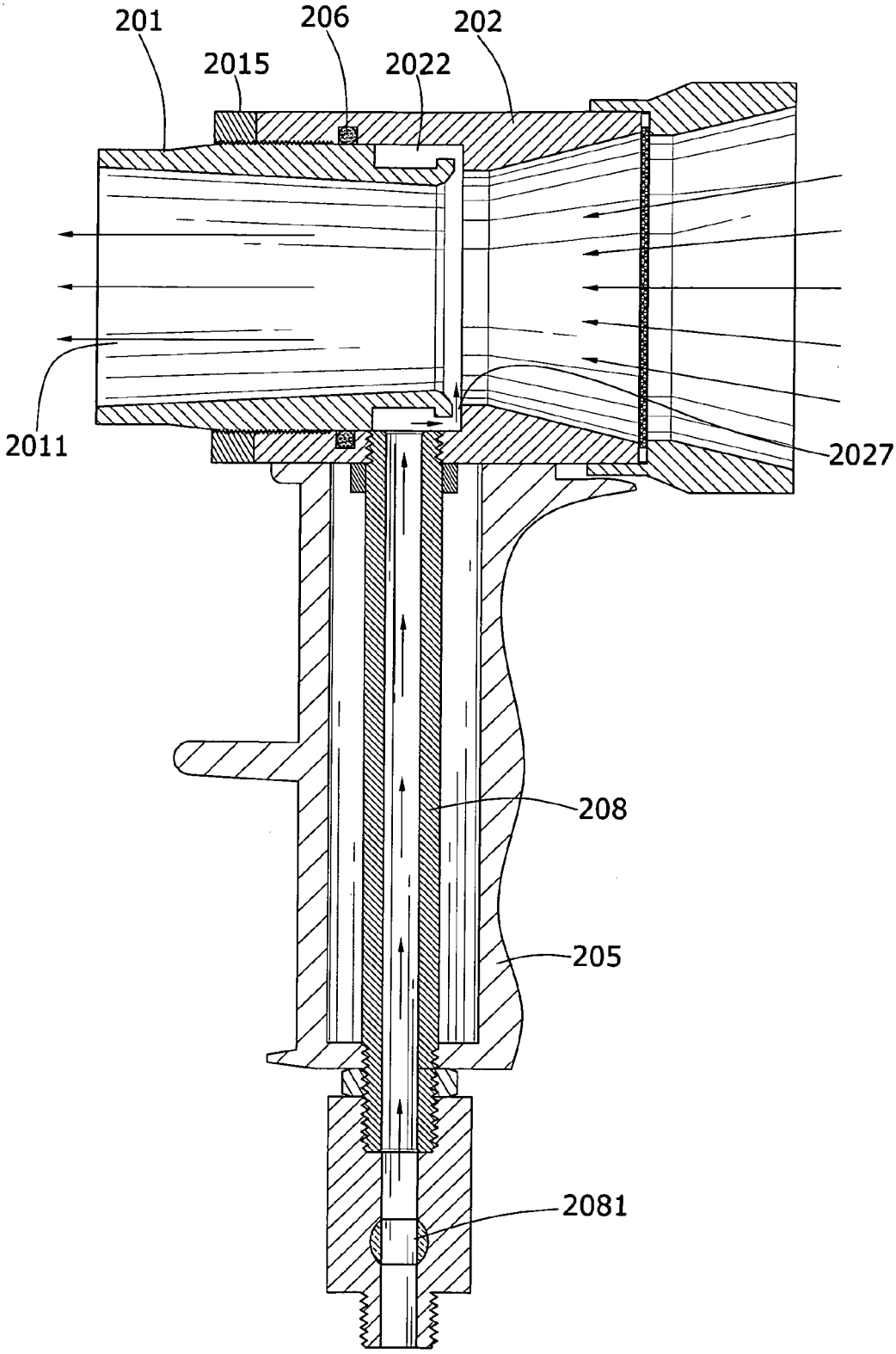
FIG. 4 shows a first schematic view of an operation of an air-taking ring of the present invention.
Figure 5:
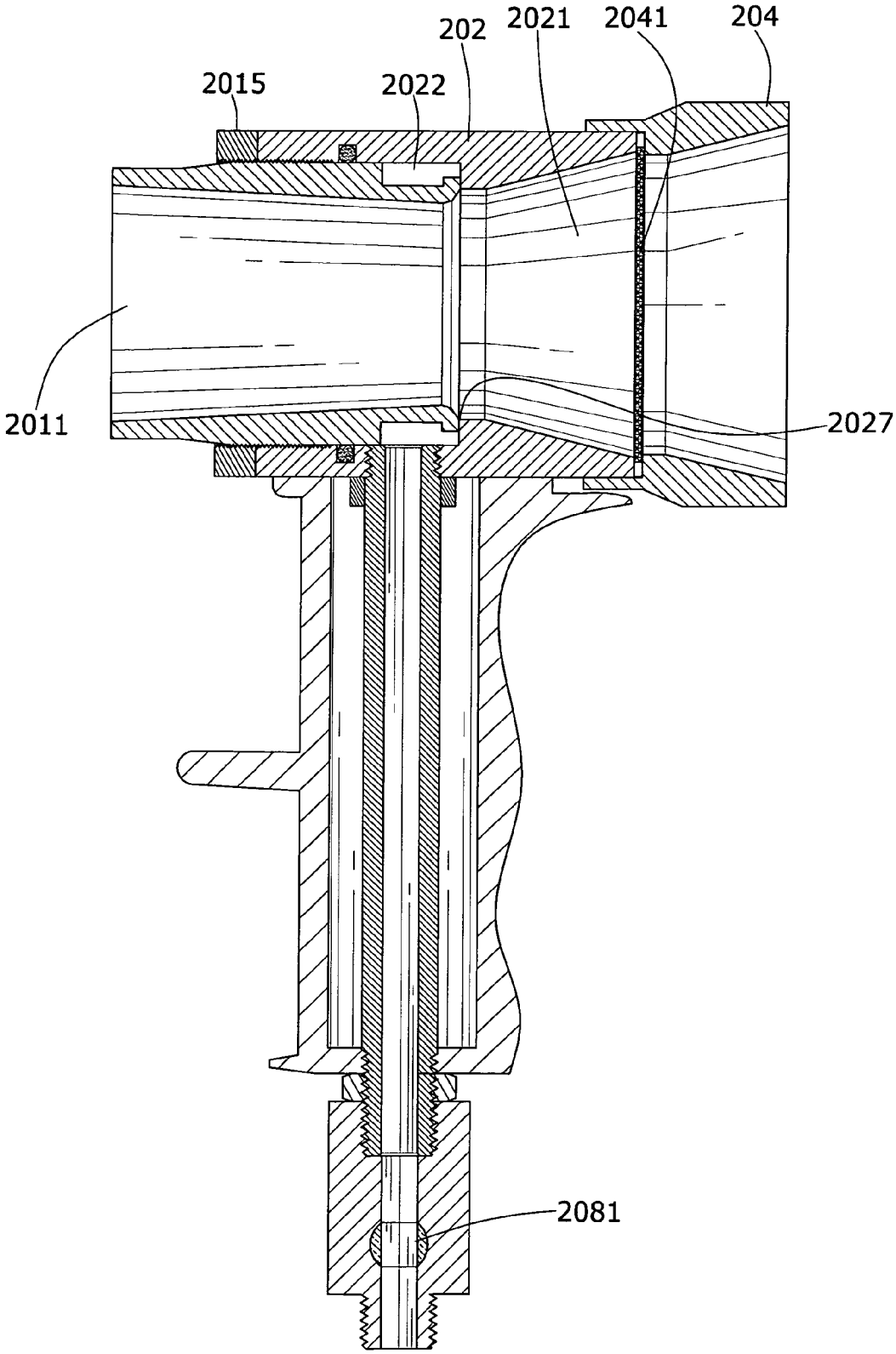
FIG. 5 shows a second schematic view of an operation of an air-taking ring of the present invention.

Referring to FIG. 4 and FIG. 5, it shows a first schematic view and a second schematic view of an operation of an air-taking ring of the present invention. The grip 205 is fixed at the bottom of the rear tube 202, and the high-pressure air tube 208 in the grip 205 is connected with the air-taking ring 2027; whereas, the high-pressure air tube 208 is connected with an air compressor or an air supply system. After high-pressure air has been delivered into the high-pressure air tube 208, the high-pressure air will be blown out toward a front side of the air-discharge conduit 2011 of the front tube 201 through the air-taking ring 2027. At a same time when the air is blown out, air at an exterior of a rear-end opening of the air-suction conduit 2021 inside the rear tube 202 will be sucked in, so as to result in an even larger air flow by the external air and the high-pressure air. In addition, through the first rubber ring 206, the air will not leak out from a gap next to the round hole 2022; whereas, impurities in the external air can be filtered out by the rear cap 204 sheathed at the rear tube 202, using the filtering net 2041 assembled inside the rear cap 204. If the high-pressure air is to be closed, the high-pressure air can be closed by using the valve switch 2081, or the front tube 201 can be locked toward the rear tube 202 (as shown in FIG. 5) by a feature that the thread-shape force exertion part 2015 formed on the front tube 201 will facilitate exerting a force, enabling the rear end of the air-discharge conduit 2011 of the front tube 201 to be tightly connected with the front end of the air-suction conduit 2021 of the rear tube 202. Accordingly, a gap space of the air-taking ring 2027 will disappear, which prohibits the high-pressure air from flowing toward the air-discharge conduit 2011 through the air-taking ring 2027, thereby achieving a result of closing the high-pressure air.

Figure 6:
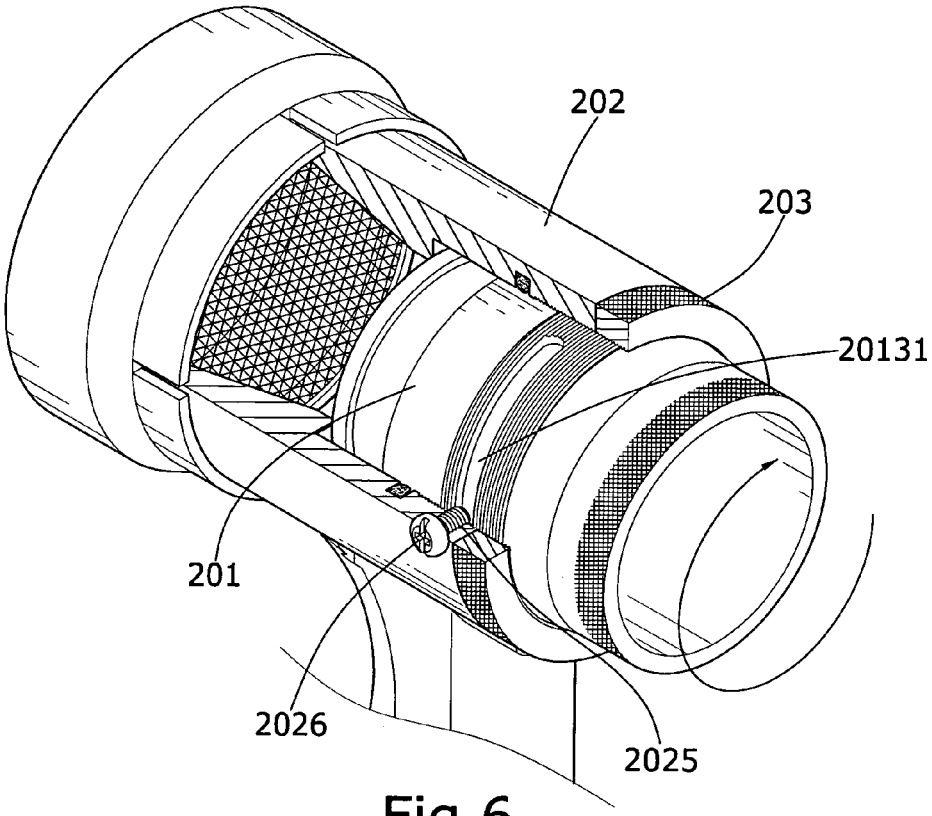
FIG. 6 shows a first schematic view of a position-limiting operation of the present invention.
Figure 7:
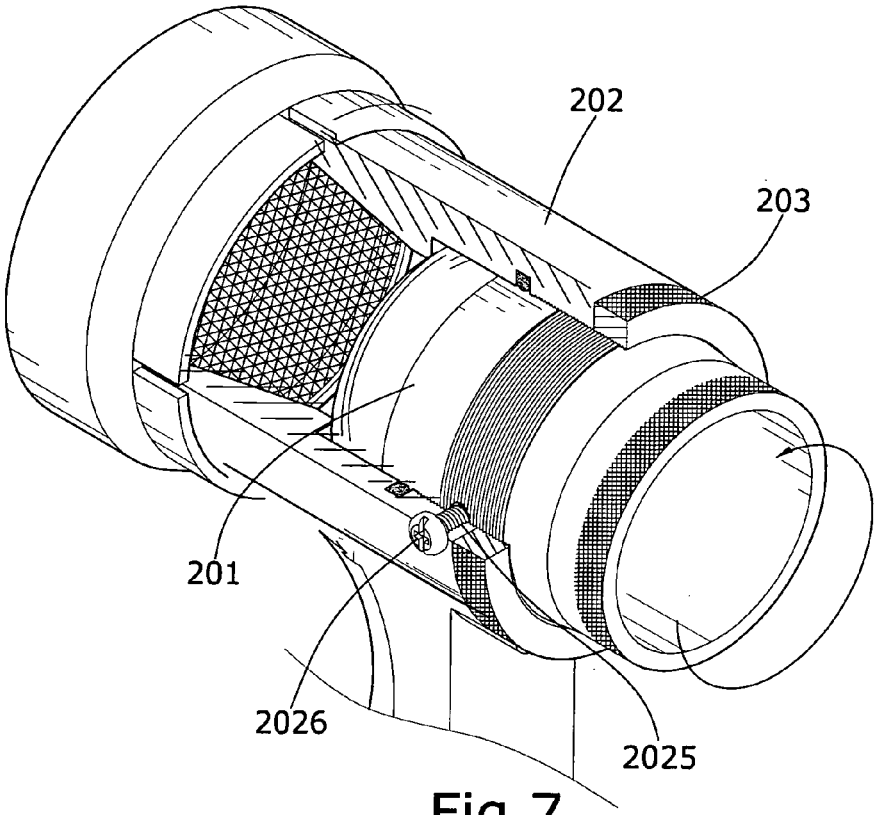
FIG. 7 shows a second schematic view of a position-limiting operation of the present invention.

Referring to FIG. 6 and FIG. 7, it shows a first schematic view and a second schematic view of a position-limiting operation of the present invention. In association with FIG. 4 and FIG. 5, as the gap size of the air-taking ring 2027 will affect a suction rate of the external air at the rear end of the rear tube 202, and the larger the gap is, the smaller the suction rate will be; therefore, a rotation range of the front tube 201 must be controlled that the gap size of the air-taking ring 2027 will be not too large. By the position-limiting element 2026, which is transfixed into the second screw-hole 2025 at one side of the rear tube 202, and an end of which is locked into the position-limiting slot 20131 of the front tube 201, when the front tube 201 rotates clockwise, the position-limiting element 2026 will be locked at one end of the position-limiting slot 20131 (as shown in FIG. 6), prohibiting the front tube 201 from rotating continuously, and closing the gap of the air-taking ring 2027 (as shown in FIG. 5). Next, when the front tube 201 rotates counterclockwise, the position-limiting element 2026 will be locked at the other end of the position-limiting slot 20131 (as shown in FIG. 7), allowing the gap of the air-taking ring 2027 to result in the largest suction rate (as shown in FIG. 4). Through the locking range between the position-limiting element 2026 and the position-limiting slot 20131, the gap of the air-taking ring 2027 can result in the largest suction rate, and the suction rate can be also increased or decreased gradually by rotating the front tube 201 as required. In addition, by using the fixing ring 203 which is screwed on the front tube 201 to be screwed and locked toward the rear tube 202, the front tube 201 can be fixed.

Accordingly, after implementing the present invention, the gap size of the air-taking ring can be adjusted by rotating the front tube, and by the locking between the position-limiting element and the position-limiting slot, as well as by the screwing between the front tube and the rear tube, the air spray gun, which can control the air blow rate and the rotation range of the front tube, and can facilitate disassembling the front tube and the rear tube to clean the dusts inside the tubes, is actually provided.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An air spray gun comprising:

a front tube, a center of which is formed with an air-discharge conduit, an outer wall of a smaller diameter at a rear section of which is formed with a groove, along an outer wall of a larger diameter in front of the groove being formed orderly with a sealing surface and an outer thread, and one side of the outer thread being formed with a positioning slot;

a rear tube, a center of which is formed with an air-suction conduit, with a front end of the air-suction conduit being formed with a round hole corresponding to the sealing surface of the front tube, a bottom of the round hole being formed with a first screw-hole, an opening end of the round hole being formed with a first inner thread, and an outer ring surface of the rear tube being formed with a second screw-hole being transfixed with a position-limiting element; and a grip, which is fixed on the first screw-hole at the bottom of the rear tube, a center of which is formed as a hollow shape for transfixing with a high-pressure air tube, enabling the high-pressure air tube to be connected with an air-taking ring, with a tail end of the high-pressure air tube being assembled with a valve switch;

after the front tube has been assembled with the rear tube, an annular air chamber being formed between the groove and a wall of the round hole, and the air-taking ring being formed between a rear-end surface of the air-discharge conduit and a front-end surface of the air-suction conduit.

2. The air spray gun according to claim 1, wherein an outer ring surface of the front tube is formed with a force exertion part.

3. The air spray gun according to claim 1, wherein the position-limiting element is a screw.

4. The air spray gun according to claim 1, wherein an interior of the round hole is assembled with a first rubber ring.

5. The air spray gun according to claim 1, wherein the first screw-hole is assembled with a second rubber ring.

6. The air spray gun according to claim 1, wherein the outer thread is screwed with a fixing ring.

7. The air spray gun according to claim 1, wherein a rear end of the rear tube is sheathed with a rear cap.

8. The air spray gun according to claim 7, wherein an interior of the rear cap is assembled with a filtering net.

* * * * *